US005971301A

United States Patent [19]

Stouffer et al.

[11] Patent Number: 5,971,301

[45] Date of Patent: Oct. 26, 1999

[54] "BOX" OSCILLATOR WITH SLOT INTERCONNECT

[75] Inventors: Ronald D. Stouffer, Silver Spring; Fred Heil, Brooklyn Park, both of Md.

[73] Assignee: Bowles Fluidic Corporation, Columbia, Md.

[21] Appl. No.: 09/139,119

[22] Filed: Aug. 25, 1998

[51] Int. Cl.[6] ..... B05B 1/08

[52] U.S. Cl. ..... 239/589.1; 239/DIG. 3; 137/826; 137/811

[58] Field of Search ..... 239/589.1, 590, 239/DIG. 3, 11; 137/811, 833, 839, 810, 825, 826, 808, 809, 813, 835

[56] References Cited

U.S. PATENT DOCUMENTS

| | | | |
|---|---|---|---|
| 4,721,251 | 1/1988 | Kondo et al. | 239/589.1 |
| 5,129,585 | 7/1992 | Bauer | 239/589.1 |
| 5,181,660 | 1/1993 | Stouffer et al. | 239/589.1 |
| 5,213,269 | 5/1993 | Srinath et al. | 239/589.1 |
| 5,213,270 | 5/1993 | Stouffer et al. | 239/589.1 |
| 5,524,660 | 6/1996 | Dugan | 137/833 |
| 5,638,867 | 6/1997 | Huang | 137/826 |

*Primary Examiner*—David J. Walczak
*Attorney, Agent, or Firm*—Jim Zegeer

[57] ABSTRACT

A low pressure fluidic oscillator having an oscillation chamber having a centerline, and a pair of mutually facing and complementary-shaped sidewalls, planar top and bottom walls, upstream end and downstream end walls. An input power nozzle is formed in the upstream end wall having a width $P_W$ and a depth $PD_D$, for issuing a jet of liquid into the oscillation chamber and forming alternately pulsating vortices in the oscillation chamber on each side of the jet, respectively. An outlet opening is formed in the downstream end wall and substantially axially aligned with the power nozzle. A pair of short sidewalls diverge in a downstream direction from the outlet opening. The distance from the power nozzle to the outlet opening being L. A slot is formed in at least one of said top and bottom walls, the slot having a slot centerline which is spaced upstream from the outlet opening a distance from about the edge of the downstream end of said oscillation chamber to about 0.48L.

4 Claims, 3 Drawing Sheets

"BOX" OSCILLATOR WITH SLOT INTERCONNECT

The present invention relates to fluidic oscillators of the type disclosed in U.S. Pat. No. 5,213,269 and U.S. Pat. No. 5,213,270 and to the improved control of patternization, frequency and quality of oscillation in this type fluidic oscillator, especially in the field of liquid spray and dispersion.

BACKGROUND AND BRIEF DESCRIPTION OF THE INVENTION

The present invention is an improvement on the low-cost, low-pressure, feedback passage-free oscillators disclosed in U.S. Pat. No. 5,213,269 and U.S. Pat. No. 5,213,270, owned by the assignee hereof. In these patents, a fluidic oscillator is disclosed which has an oscillation chamber having a length greater than its width and a pair of mutually facing complementary shaped sidewalls with planar top and bottom walls and first and second ends walls and is generally "box" shaped. An input power nozzle is formed in the first end wall for issuing a stream of liquid into the oscillation chamber, and an outlet is formed in the second end wall to issue a sweeping jet to ambient. Alternately pulsating substantially cavitation-free vortices are formed in the chamber. This defines a standard box fluidic oscillator. In U.S. Pat. No. 5,213,269, an interconnect passage or channel proximate the downstream end wall, enlarges the sweep angle and improves periodicity of the oscillations.

The present invention is an improvement on the fluidic oscillator disclosed in U.S. Pat. No. 5,213,269 by improving the patternization, frequency and quality of oscillations of the fluidic oscillator disclosed in U.S. Pat. No. 5,213,269. This has been done by incorporation of a transverse slot which connects the fluid from regions on opposite sides of the power jet a substantial distance downstream thereof and in advance of the outlet throat and orifice. In the preferred embodiment, the distance of the transverse slot from the output is from about the edge of the downstream end of the oscillation chamber to about 0.48L where L is the distance from the power nozzle to the outlet opening in the oscillation chamber. In this position, the transverse slot provides a method of controlling the patternization, the spray distribution across the fan angle of the output, the average frequency and the amount of time spent in steady predictable oscillations. This results in liquid oscillators which are less expensive to manufacture and produces a higher manufacturing yield. While rectilinear slots are disclosed, other slot shapes can be used.

BRIEF DESCRIPTION OF THE DRAWINGS

The above and other objects, advantages and features of the invention will become more apparent when considered in conjunction with the following specification and accompanying drawings, wherein.

DETAILED DESCRIPTION OF THE INVENTION

Figure 1:
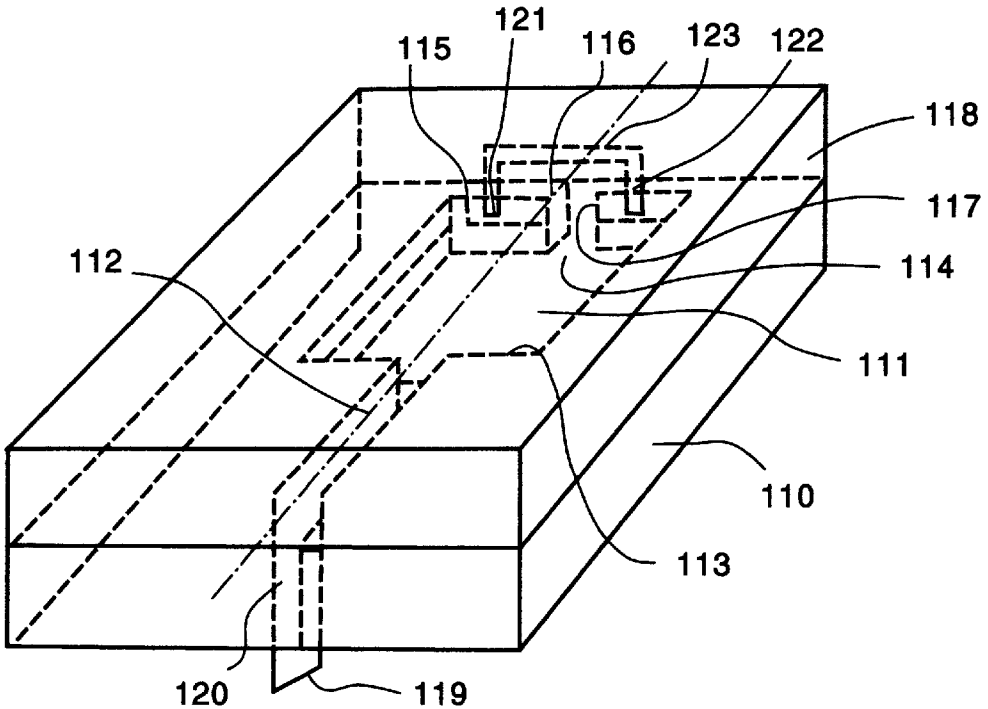
FIGURE 1 (PRIOR ART)
FIG. 1 (prior art) is an illustration from U.S. Pat. No. 5,213,269.

Referring specifically to FIG. 1 (prior art (FIG. 10 of U.S. Pat. No. 5,213,269)), a first plate member 110 has an oscillation chamber 111 (with a length L) molded therein, power nozzle 112 (having a width $P_W$ and a depth $P_D$ in an upstream wall 113 and an outlet opening 114 in a downstream wall 115. A pair of short diverging walls 116 and 117 provide physical sweep angle limiting boundaries. Pipe 119 is coupled to a bore 120 conveying operating fluid to the power nozzle 112 which issues a jet of fluid under pressure into oscillation chamber 111. A second plate 118 is joined to plate 10 to provide a top wall to chamber 111. Plate 118 has a pair of spaced holes or bores 121, 122, one on each side of centerline CL and proximate the downstream end walls 115. The spaced ends of 121 and 122 are connected by a transverse passage 123 to form an interconnect passage. The interconnect passage has the effect of making the sweep angle significantly large (from for example 25° to 35° to 50° to 70°; a 45° to 50° sweep is enlarged to a 90° to 100° sweep angle as another example). Addition of the transverse interconnect passage or channel improves the periodicity of the oscillations, and as a result droplets are formed from the jet when the jet is issued to ambient and have a spacing and size distribution which is the same as oscillators of the type disclosed in Stouffer U.S. Pat. No. 4,508,267.

The present invention is directed to improvements in patternization, spray distribution across the fan angle and in amount of time spent in steady predictable oscillation of oscillators of the type disclosed in FIG. 1. According to the present invention, instead of the interconnect passage 123, a transverse slot is provided upstream of the outlet to a point between about the edge of the downstream end of the oscillation chamber 111' and 0.48L of the distance from the outlet.

Figure 2:
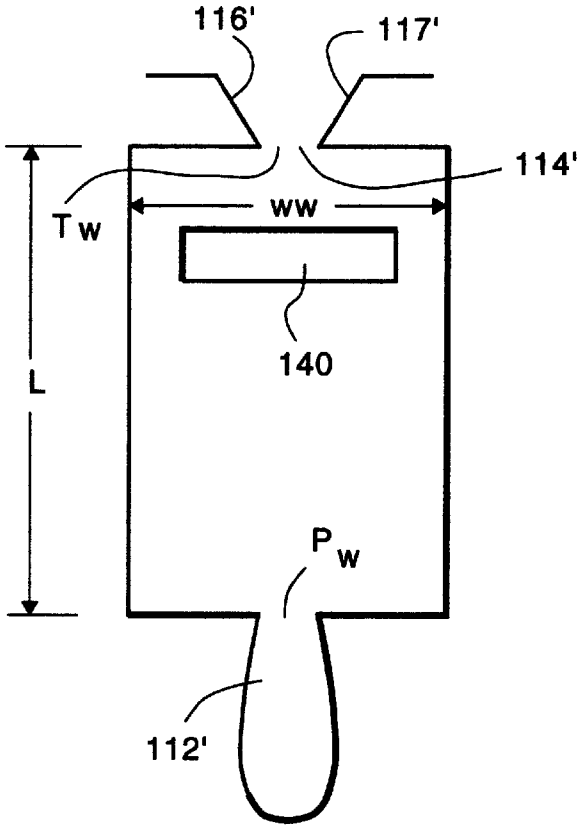
FIG. 2 is a top plan a view of a silhouette of a liquid oscillator incorporating the invention.
Figure 4:
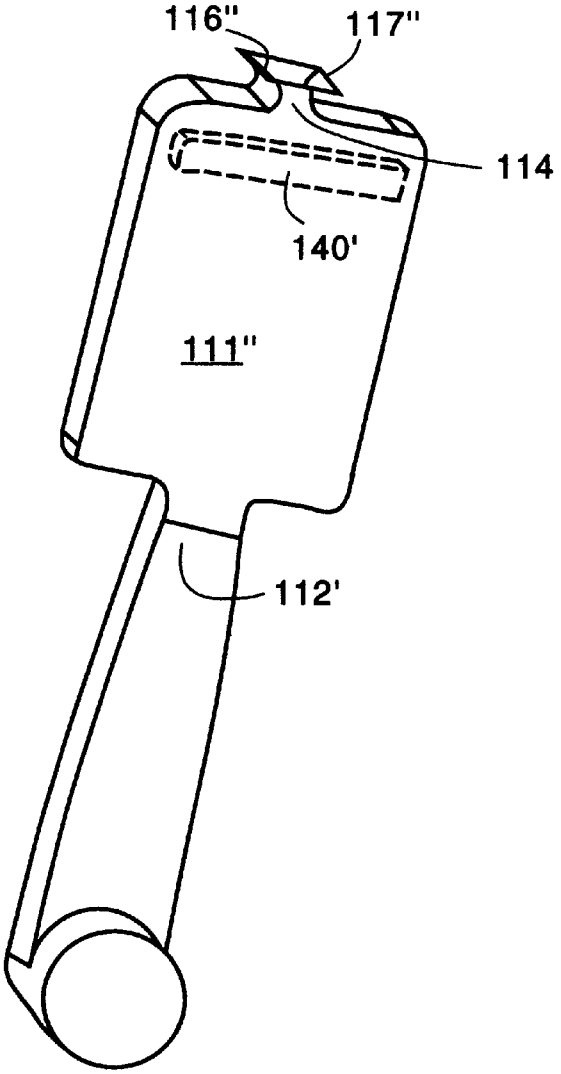
FIG. 4 is an isometric view of a liquid spray device power nozzle, oscillation chamber, slot and outlet element incorporating the invention.
Figure 3:
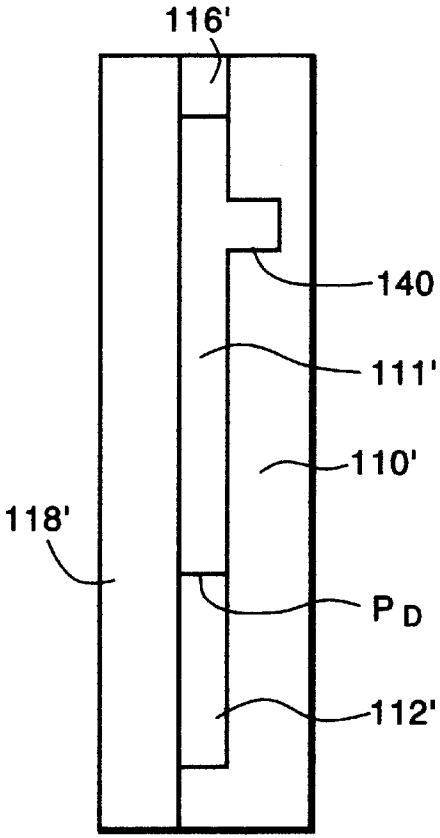
FIG. 3 is a sectional side view of the liquid oscillator of the present invention.

As shown in FIGS. 2, 3 and 4, a box oscillator incorporating the invention has a transverse slot 140 formed in at least one of the top walls of chamber 111' or bottom wall of the chamber 111'. Preferably, slot 140 is formed in the bottom wall so that its position will always be accurately located or fixed relative to the fluidically functional components of the chamber 111', and the power nozzle 112'. Based on the parameters set out below, the slot 140 is located at or upstream of the outlet throat 114'.

Figure 6:
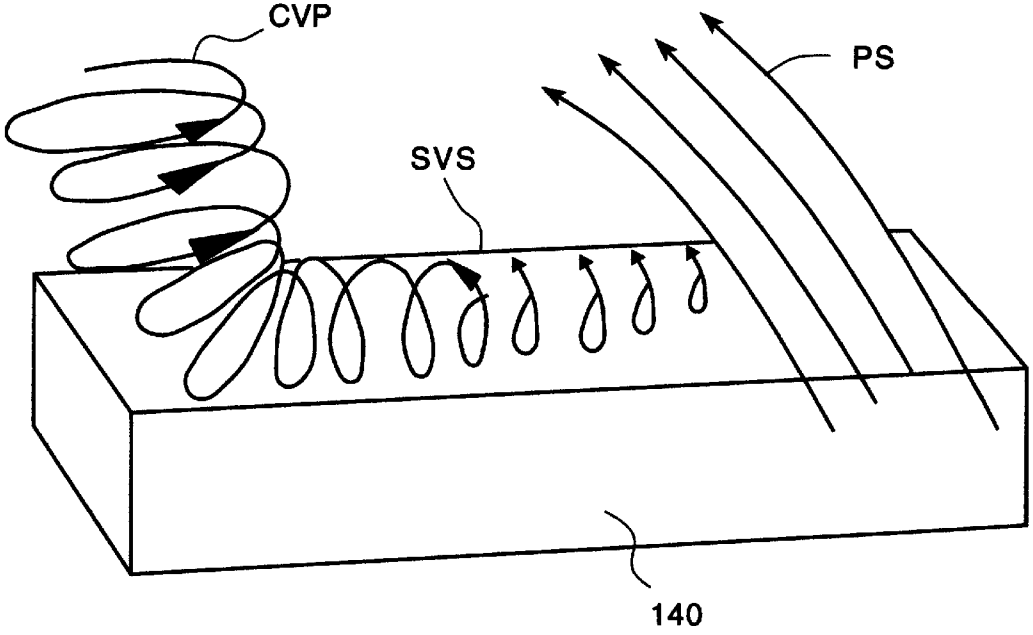
FIG. 6 is a diagrammatic illustration of the stream controlling vortices and slot flow characteristics.
Figure 5:
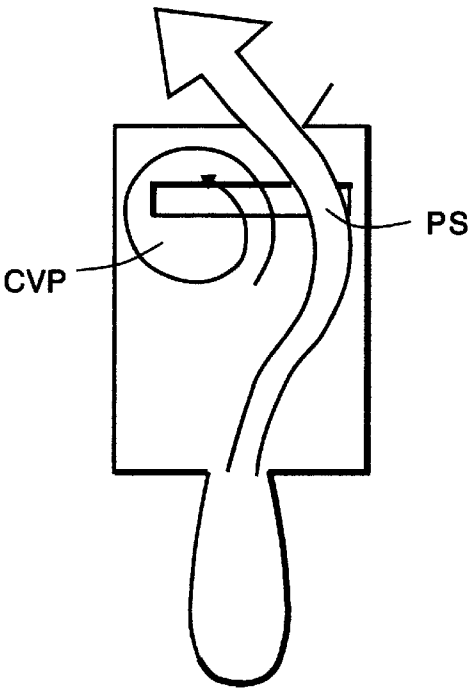
FIG. 5 is a diagrammatic illustration for showing the flow pattern and stream controlling vortices formed in the oscillation chamber.

Referring to FIGS. 5 and 6, the stream controlling vortical pattern CVP (which derives its energy from the power stream but interacts back on the power stream to cause it to bend) is rotating in the same direction as the slot vortical system SVS.

In fact, the two systems can actually be visualized as one in the form of a vortical tapering column bent at 90°. The larger, controlling vortex CVP has a negative pressure relative to the smaller slot vortex SVS which has a relative positive pressure near to the power stream. This pressure differential derives the vortical system in an axial direction not unlike a retreating tornado.

The alternating nature of the oscillating power stream is associated with alternating pressure differentials between opposite sides of the jet. The slot provides a fluid path to moderate this pressure differential and thereby control the switching dynamics of the oscillating power jet. This control is detected by observing the range of patternization, the frequency, and the time spent in steady oscillation.

The oscillations of the box oscillator, like other somewhat chaotic fluidic oscillator systems, derive their robustness from having the ability to recover from severe perturbations to restore the oscillation to an original condition of normalcy. The box oscillator has been observed as having robustness relative to perturbations in its geometry such as is done while experimenting with geometric changes in the course of development of a silhouette. It is noted that the oscillation characteristic changes only in small amounts when perturbed by relatively large geometry changes.

The robustness is characterized by occasional resetting of its oscillating rhythm. It maintains a steady oscillation mode for a time, then hesitates, and then restarts into the steady mode. This capability of restarting allows the oscillator to recover from extreme perturbations.

According to the present invention, a box oscillator with a slot interconnect extending transversely from side to side proximate the outlet throat third of the chamber or interaction region has about twice the fan angle of a standard box and exhibits more regular oscillations and "standard box" oscillators with slot 140, as disclosed herein, are much simpler to build. The optimum slot geometry and location and tolerances are set forth below.

For the following design guide the standard fluidic terminology applies with the additions for the slot of:

$S_W$—width of slot.

$S_D$—depth of slot.

$S_L$—length of slot.

$S_X$—distance from slot centerline to throat end of chamber.

$P_W$—width of power nozzle.

$T_W$—outlet throat width.

$W_W$—width of oscillation chamber at slot location.

| Variable | Range | Ideal |
|---|---|---|
| $S_W$ | $.16P_W$ to $1.28\ P_W$ | $.64P_W$ |
| $S_D$ | $.16P_W$ to $1.28\ P_W$ | $.64P_W$ |
| $S_L$ | $2T_W$ to $W_W$ | $2T_W$ to $W_W$ |
| $S_X$ | 0 to .48L | 0 to .33L |

Where $P_W$ is the width of the power nozzle L is the distance from the power nozzle to the outlet throat.

Outside of these ranges the performance deteriorates. For instance, as the slot gets closer to the power nozzle the oscillations quit, leaving the jet stuck to one side. Towards the top of the circuit, a very slow steady oscillation begins, e.g. at slot distance $S_X$, of about 0.48L.

While preferred embodiments of the invention have been shown and described herein, it will be appreciated that various embodiments, adaptations and modifications of the invention will be apparent to those skilled in the art.

What is claimed is:

1. In a low pressure fluidic oscillator having:

an oscillation chamber having a centerline, and a pair of mutually facing and complementary-shaped sidewalls and planar top and bottom walls, upstream end and downstream end walls, means forming an input power nozzle in said upstream end wall having a width $P_W$ and a depth $P_D$, for issuing a stream of fluid into said oscillation chamber, and form alternately pulsating vortices in said oscillation chamber on each side of said stream, respectively, an outlet opening formed in said downstream end wall and substantially axially aligned with said power nozzle, a pair of short sidewalls diverging in a downstream direction from said outlet opening, and the distance from said power nozzle to said outlet opening being L, the improvement comprising a slot formed in at least one of said top and bottom walls, said slot having a centerline, said centerline being spaced upstream away from said outlet opening a distance from about the edge of the downstream end of said oscillator chamber to about 0.48L.

2. The lower pressure fluidic nozzle defined in claim 1 wherein said slot is a rectangular groove formed in one of said planar top and bottom walls and having a length from at least about twice the width of said outlet opening.

3. In a liquid oscillator having means forming an oscillation chamber having a centerline, an upstream wall and a power nozzle formed in said upstream wall for issuing a jet of liquid into said oscillation chamber, said power nozzle having a width $P_W$ and a depth $P_D$, a downstream wall having liquid outlet therein for issuing a sweeping liquid jet to ambient, said liquid outlet having a width $T_W$, said power nozzle means and said liquid outlet being aligned along said centerline and spaced a distance L away from each other, a pair of spaced sidewalls connecting the lateral ends of said upstream and downstream walls, respectively, top and bottom walls, and interconnect passage means proximate said downstream wall and interconnecting the portions of said oscillation chamber at each side of said centerline for enhancing the sweep angle of the jet issued to ambient and causing the oscillations in said oscillation chamber to be more periodic, the improvement for controlling patternization, frequency and quality of the oscillation in said oscillation chamber and simplifying the construction, comprising said interconnect passage means being constituted by at least one slot having a width in the range of $0.16P_W$ to $1.28P_W$, a depth from about $0.16P_W$ to about $1.28P_W$, and a length of from about $2T_W$ to $W_W$ and having a slot centerline with said centerline being spaced away from said outlet end a distance from about the edge of the downstream end of said oscillation chamber to about 0.48L, $W_W$ having the width of said chamber at said centerline.

4. The liquid oscillation defined in claim 3 wherein said slot has a width of about $0.64P_W$, a depth of about $0.64P_W$,a length of about $2T_W$ to $W_W$ and said centerline is spaced from said outlet end a distance of about from the edge of the downstream and of said oscillator chamber and 0.33L.

* * * * *